United States Patent [19]

Schulte

[11] Patent Number: 5,004,213

[45] Date of Patent: Apr. 2, 1991

[54] LEAF-SPRING HARDENER

[75] Inventor: Helmut Schulte, Ennepetal-Voerde, Fed. Rep. of Germany

[73] Assignee: Luhn & Pulvermacher GmbH & Co., Hagen, Fed. Rep. of Germany

[21] Appl. No.: 466,029

[22] Filed: Jan. 17, 1990

[30] Foreign Application Priority Data

Jan. 21, 1989 [DE] Fed. Rep. of Germany ..... 3901752

[51] Int. Cl.[5] ..... C21D 1/62

[52] U.S. Cl. ..... 266/116; 266/133

[58] Field of Search ..... 266/112, 116, 132, 133

[56] References Cited

U.S. PATENT DOCUMENTS

| | | | |
|---|---|---|---|
| 2,473,445 | 6/1949 | Reed | 266/116 |
| 3,094,576 | 6/1963 | Gogan | 266/133 |
| 3,396,956 | 8/1968 | Hildebrand | 266/116 |
| 3,964,734 | 6/1976 | Krieder et al. | 266/133 |

*Primary Examiner*—S. Kastler

*Attorney, Agent, or Firm*—Herbert Dubno; Andrew Wilford

[57] ABSTRACT

An apparatus for bending leaf-spring blanks is combined with a vessel containing a bath of a hot treatment liquid and defining a longitudinal treatment path below a surface of the liquid, a center guide extending longitudinally along the path in the bath, and a pair of side guides extending longitudinally along the path and spacedly horizontally flanking the center guide. Each guide has an upper element and a lower element spaced therebelow. A loader engages the blank in the bending apparatus generally centrally for removing the engaged blank form the bending apparatus, and for depositing the blank in the bath between the upper and lower guide elements. In addition a conveyor including center and side pushers is displaceable longitudinally along each of the respective guides for engaging the blank engaged therein and displacing same along the path through the guides between the upper and lower elements.

11 Claims, 3 Drawing Sheets

LEAF-SPRING HARDENER

FIELD OF THE INVENTION

The present invention relates to the manufacture of leaf spings. More particularly this invention concerns an apparatus for hardening leaf springs.

BACKGROUND OF THE INVENTION

A leaf spring is made by bending a steel bar into a normally curved shape, and then heating it to temper the steel and impart the required springiness to it. To this end the steel blank is typically bent in a machine of the type described in the publication *Blattfedern biegen und harten in automatischen Anlagen* ("Leaf-spring bending and hardening in automatic machines" by Hans Hermann Kallenberg, special publication of Vogelverlag Würzburg, 29th year, Bäander, Bleche, Rohre, February 1989). This machine has holding jaws between which the normally straight spring blank is gripped and curved jaws that grip and bend the workpiece to the desired shape.

As a rule the jaws of the bender are removable so that the workpiece, or workpieces when two are bent at the same time, are taken out of the bender while still gripped by the jaws, and then the bent workpiece plus the jaws are passed through the heat-treatment bath. Only after the assembly is taken out of the treatment bath are the jaws opened up, separated from the tempered workpiece, and returned to the bending apparatus.

Thus with the known system it is necessary to provide a number of sets of bending jaws determined by the amount of time it takes to return a set of jaws to the bender dividied by the cycling time of the slowest step of the bending/hardening process. Since the bending jaws must be set up specially for the workpiece shape, this entails a consideragble amount of equipment and a considerable amount of time reconfiguring it each time workpiece shape changes.

OBJECTS OF THE INVENTION

It is therefore an object of the present invention to provide an improved heat-treatment apparatus for a bent spring workpiece.

Another object is the provision of such an improved heat-treatment apparatus for a bent spring workpiece which overcomes the above-given disadvantages, that is which simplifies the bending equipment and which also cuts reconfiguration time.

SUMMARY OF THE INVENTION

The instant invention is used in combination with an apparatus for bending leaf-spring blanks. It comprises a vessel containing a bath of a hot treatment liquid and defining a longitudinal treatment path below a surface of the liquid, a center guide extending longitudinally along the path in the bath, and a pair of slide guides extending longitudinally along the path and spacedly horizontally flanking the center guide. Each guide has an upper element and a lower element spaced therebelow. A loader engages the blank in the bending apparatus generally centrally for removing the engaged blank from the bending apparatus, and for depositing the blank in the bath between the upper and lower guide elements. In addition a conveyor including center and side pushers is displaceable longitudinally along each of the respective guides for engaging the blank engaged therein and displacing same along the path through the guides between the upper and lower elements.

Thus with the systems of this invention the bending jaws can be permanently mounted in the bending apparatus. This represents a substantial saving on equipment costs and makes reconfiguring the jaws for a differently shaped workpiece easy.

According to the invention the bent workpiece is gripped to each side of its center by a double-fork loading device and is deposited on the lower guide elements, whereupon it is moved downstream by the pushers. This system is efficiently used with a three-jaw bender so that the loader picks the bent workpiece horizontally out of the open jaws, moves it horizontally above the upstresam end of the path, and then lowers it into the bath. At the downstream end another such double-fork device is used to pick up and remove the tempered workpiece. Separate forks can be used for fetching the workpiece out of the bender and then loading it into the bath. It is also within the scope of this invention to provide transport forks that grab the ends of the workpiece, a system particularly useful with very thin springs to prevent them from losing their shape.

In accordance with this invention the center guide includes two upper center guide elements and two center lower guide elements. The conveyor includes a chain carrying the center pushers and having a stretch between the center lower guide elements. Furthermore means is provided for vertically displacing and fixing the upper center guide element relative to the lower center guide element so that the vertical spacing between the center guide elements can be varied.

The conveyor according to the invention also includes a pair of side chains carrying the side pushers and having a stretch adjacent the side lower guide elements. Means is also provided for vertically displacing and fixing the upper side guide elements relative to the lower side guide elements so that the vertical spacing between the side guide elements can be varied. This allows the machine to accommodate springs of different thickness.

For more adjustability respective side supports pivoted about at least one generally central longitudinal axis have outer ends carrying the side guides. These side supports can be pivoted and fixed along with the guides carried thereby so as to set the vertical positions of the side guides relative to the center guide. The pivoting system includes a motor mounted stationarily adjacent the vessel. In addition each of the supports is provided with transversely extending support elements along which the respective guide and pushers are transversely displaceable so that the horizontal position of the side guides relative to the center guide can be varied.

The lower guide elements according to this invention have upstream and downstream ends extending longitudinally past the respective upper guide elements.

DESCRIPTION OF THE DRAWING

The above and other objects, features, and advantages will become more readily apparent from the following, reference being made to the accompanying drawing in which.

SPECIFIC DESCRIPTION

Figure 1:
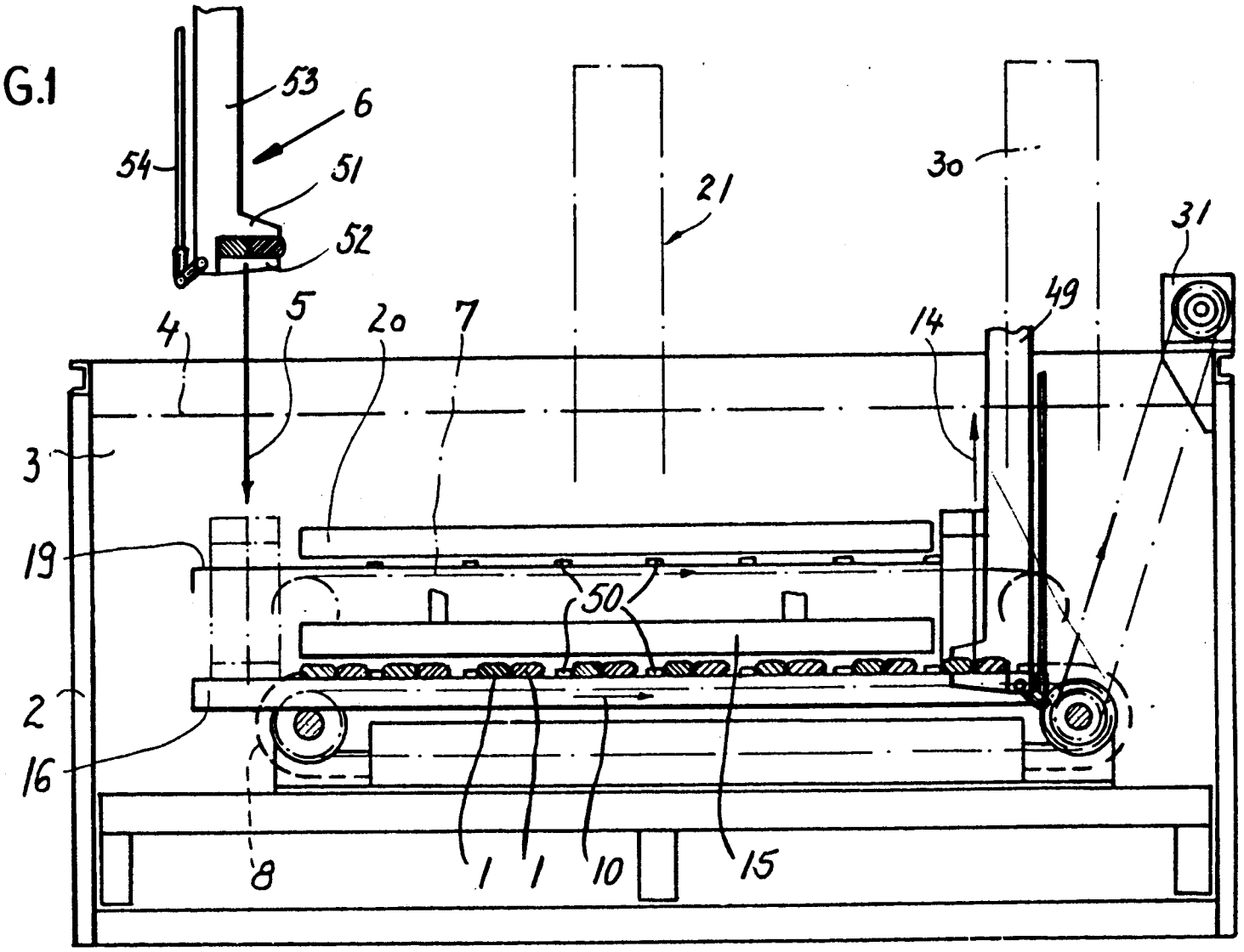
FIG. 1 is a largely diagrammatic vertical longitudinal section through the heat-treating apparatus according to this invention.
Figure 2:
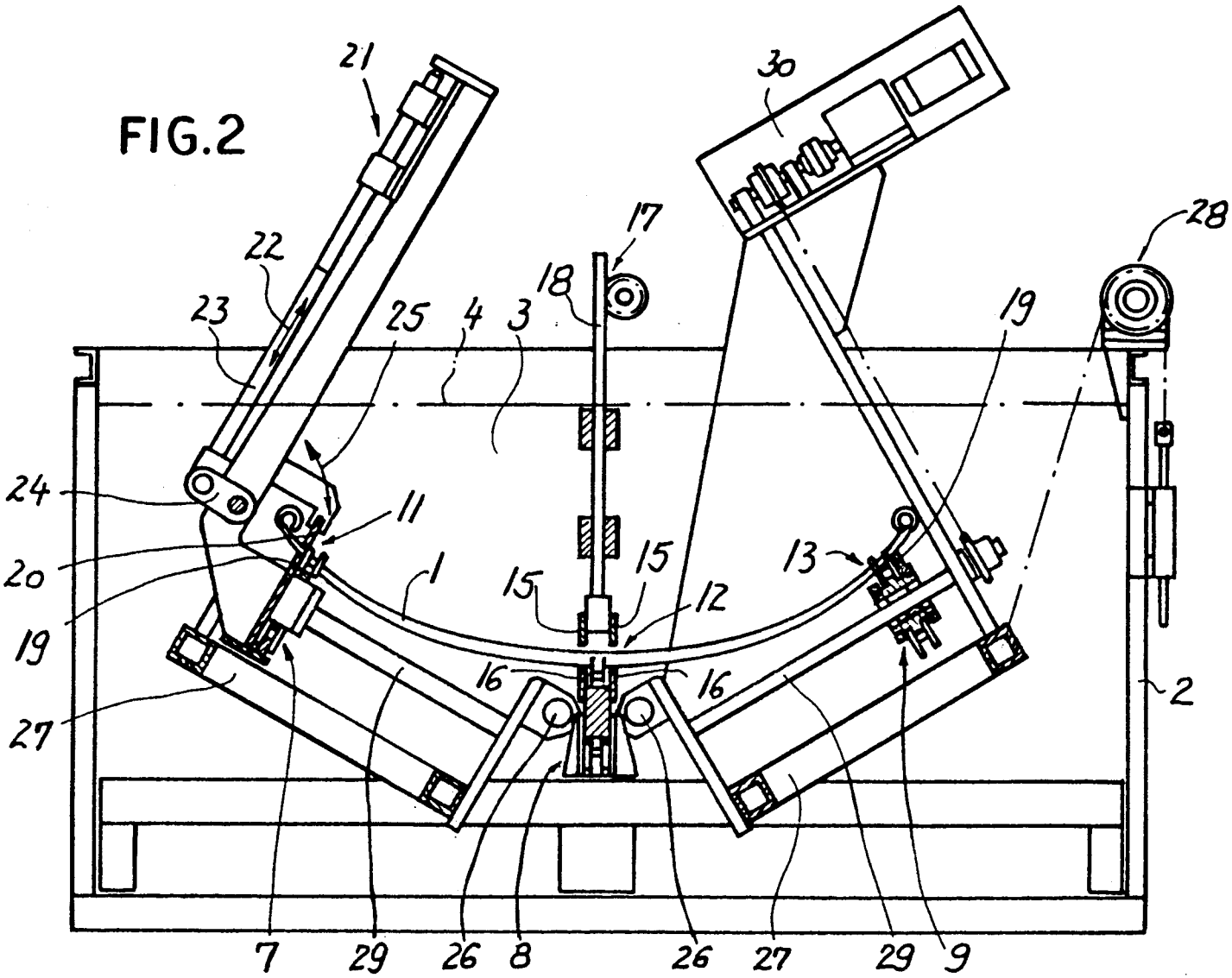
FIG. 2 is a vertical cross section through the apparatus.
Figure 3:
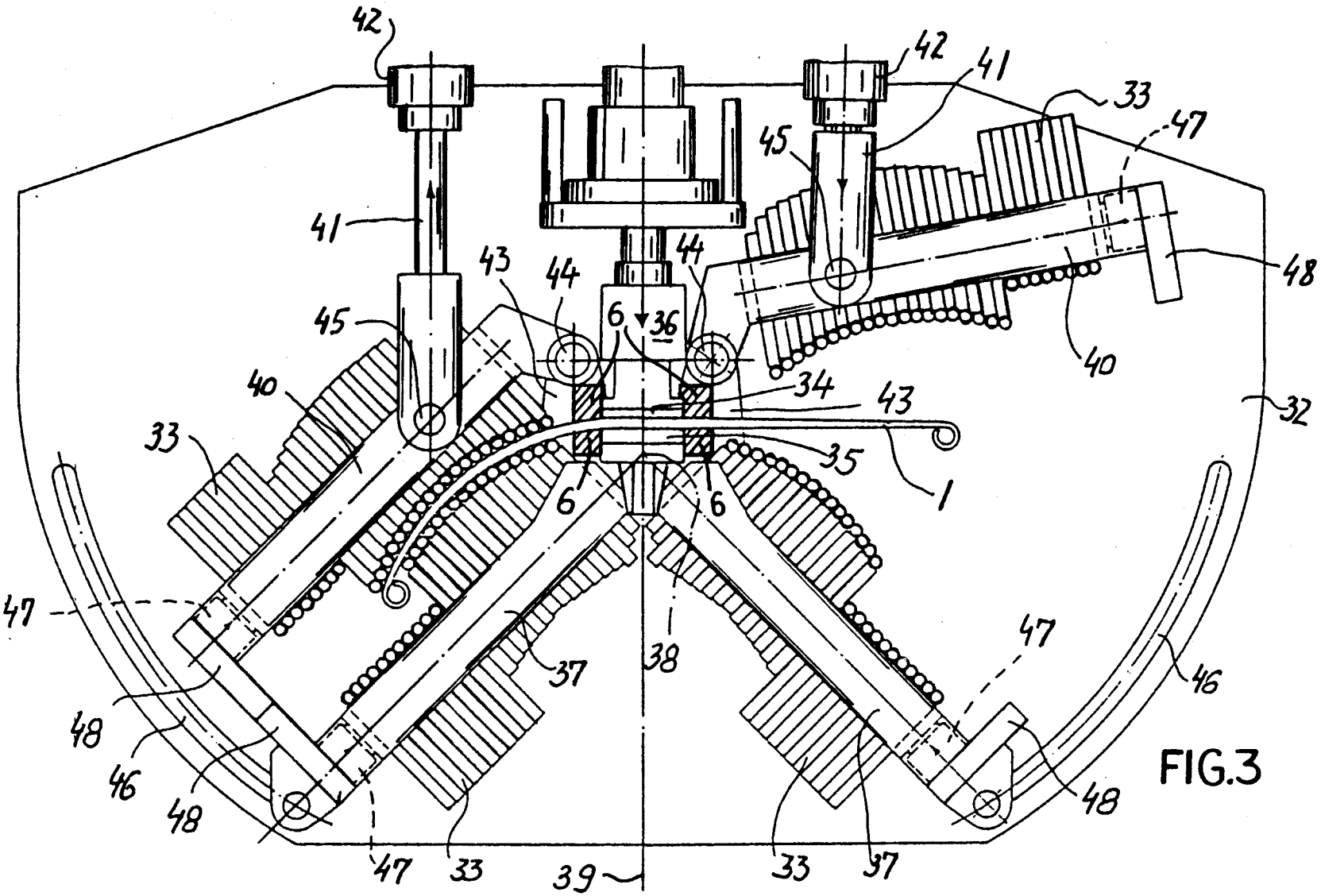
FIG. 3 is a vertical section through the bender and loading conveyor upstream of the apparatus of this invention.

As seen in FIGS. 1 and 2 a leaf-spring workpiece blank 1 bent in the apparatus described below with reference to FIG. 3 is heat treated in a hot, for instance molten-salt, bath 3 having an upper surface 4 and held in a vessel 2 that is typically set in the ground. The vessel 2 is provided with unillustrated heating and circulating means for keeping the bath 3 hot and is usually associated with vapor- and spark-aspiration devices and the like to avoid contaminating the surroundings.

The workpieces 1 are upwardly concavely curved and are loaded into the treatment vessel 2 in a direction 5 by a loading device 6 (see FIG. 3) that includes an upper fork 51 and a lower fork 52 whose tines grip the workpieces 1 to each side of their centers after they are bent. The fork 51 is fixed on a vertically and horizontally displaceable support 53 and the fork 52 is pivoted thereon. An actuator partially shown at 54 can open and close the device 6.

The workpieces 1 are displaced by conveyors 7, 8, and 9 in a direction 10 to a downstream end (right in FIG. 1) of the vessel 2 where they are lifted out in a direction 14 by another fork arrangement 49 of substantially identical construction as the fork 6, but open upstream rather than downstream. The loading and unloading devices 6 and 49 are both operated by motor arrangements fixed stationarily adjacent the vessel 2.

The conveyors 7, 8 and 9 are formed by the upper stretches of respective endless chains carrying pushers 50. These conveyor chains 7, 8, and 9 are associated with respective guides 11, 12, and 13 that define longitudinally extending slots for the ends and middle of the workpieces 1. The center guide 12 is formed by a pair of upper guide rails 15 and a pair of lower guide rails or elements 16, the latter being fixed in the vessel 1 and flanking the center conveyor chain 8 and the side guides 11 and 13 are similarly formed by lower rails 19 and upper rails 20. The upper rails 15 are carried on a frame 18 that can be vertically displaced by a drive indicated schematically at 17 in FIG. 2 to adjust the height of the gap defined by the center guide 12. The lower guide elements 16 and 19 extend longitudinally at both ends past the respective upper guide elements 15 and 20 so that the workpieces 1 will be supported thereby at the ends of their travel through the machine.

Each of the side guides 11 and 13 is formed by the respective lower guide rail 19 and an upper rail 20, both carried on the respective support frame 27 pivoted at 26 centrally of the vessel 1. Each upper side guide element 20, of which only the left-hand one is shown in FIG. 2 for clarity of view, is connected via a lever 24 to a piston rod 23 of an actuator 21 so that displacement of this rod 23 as indicated by arrow 22 can vertically displace the upper guide rail 20 relative to the respective lower rail 19 as shown by arrow 25 and thereby also vary the height of the slot defined thereby.

The supports 27 carry shafts 29 on which the sprockets of the respective chains 7 and 9 and the guides 11 and 13 are carried so that these elements can be moved transversely of the center guide 12 to accommodate workpieces 1 of different lengths. Drive motors 30 for the conveyor chains 7 and 9 are provided on the frames 27 and the vessel 2 is similarly provided with a drive motor 31 for the center conveyor 8. Motors 28 mounted on the vessel 2 can pivot the support frames 27 to set the vertical positions of the side-guide gaps relative to the center-guide gap.

As seen in FIG. 3 and as described in detail in my copending patent application Ser. No. 464,426 filed 12 Jan. 1990 one or two workpieces 1 is formed in an apparatus having a stationary frame 32 carrying an upper jaw assembly 34, 40 and a lower jaw assembly 34, 37. The apparatus is basically symmetrical to a vertical plane 39 and in fact operates symmetrically although for purposes of view the right-hand half of the apparatus is shown in FIG. 3 in a position different from that of the left-hand half.

The upper jaw assembly basically comprises a center jaw 34 having a flat lower face centered on the plane 39 and vertically displaceable by a hydraulic ram 36, and a pair of identical side jasw 40 each having a plurality of shape-defining fingers 33. The side jaws 40 have inner ends pivoted at 44 on supports 43 fixed on the frame 32, these pivots 44 being parallel and horizontal and symmetrically flanking the plane 39. The side jaws 40 are jointly displaced by heavy-duty hydraulic rams 42 having piston rods 41 pivoted at 45 on the jaws 40 offset outward from the axes 44. The upper ends of the rams 42 are pivoted on the frame 32 about axes parallel to the axes 44.

The lower jaw assembly comprises a stationary center jaw 35 having a horizontal upper face underneath the jaw 34, and two side jaws 37 basically constructed like the jaws 40 and pivoted at an axis 38 lying on the plane 39 underneath and parallel to the pivots 44. The jaws 37 have outer ends riding in arcuate guides 46 formed in the frame 32 and can be secured at any position therein. In the illustrated position they are at the bottom ends of the guides 46 and extend at an angle of 90° to each other, that is at 45° to the plane 39. If at the opposite upper ends of the guides 46 they would extend straight, that is at an angle of 180° to each other.

The outer ends of the jaws 37 and 40 carry engageable abutment blocks 48 that meet as shown on the left in FIG. 3 when they are closed together. In addition each jaw 37 and 40 carries a clamping cylinder 47 that can secure the respective shape-defining fingers 33 in place.

Thus according to this invention once the apparatus of FIG. 3 has bent the workpieces 1 into the desired upwardly concave shape, the double fork engages the bent workpieces 1 to each side of the center jaws 35 and 36 and all the jaws of the bonding apparatus open. The fork 6 then sets the workpiece on the projecting upstream ends of the lower guide rails 16 and 19.

Thereafter the workpieces 1, which can be bent and handled two at a time, move in direction 10 through the bath 3 until they come to the projecting downstream ends of the rails 16 and 19, whereupon the unloading forks 49 will lift them out. Meanwhile the bending machien is forming new workpieces 1 which are loaded into the upstream end of the bath 3.

I claim:

1. In combination with an apparatus for bending leaf-spring blanks, an apparatus for hardening the bent blank and comprising:

a vessel containing a bath of a hot treatment liquid and defining a longitudinal treatment path below a surface of the liquid;

a center guide extending longitudinally along the path in the bath and including at least one normally stationary upper center guide element and spaced therebelow at least one normally stationary lower center guide element defining with the upper center guide element a longitudinally extending center gap;

a pair of side guides extending longitudinally along the path and spacedly horizontally flanking the center guide, each side guide having a normally stationary upper side guide element and a normally stationary lower side guide element spaced therebelow and defining with the respective upper side guide element a respective longitudinally extending side gap;

loading means for engaging the blank in the bending apparatus generally centrally, for removing the engaged blank from the bending apparatus, and for depositing the blank in the bath between the upper and lower guide elements with a center of the blank engaged in the center gap and ends of the blank engaged in the side gaps, whereby the blank is constrained against deforming by engagement with the guide elements; and conveyor means including center and side pushers displaceable longitudinally along the respective guides for engaging the blank engaged therein and displacing same along the path through the guides between the upper and lower elements.

2. The hardening apparatus defined in claim 1 wherein the center guide includes two such upper center guide elements and two such center lower guide elements, the conveyor means including a chain carrying the center pushers and having a stretch between the center lower guide elements.

3. The hardening apparatus define in claim 1, further comprising means for vertically displacing and fixing the upper center guide element relative to the lower center guide element, whereby the vertical spacing between the center guide elements can be varied.

4. The hardening apparatus defined in claim 1 wherein the conveyor means includes a pair of side chains carrying the side pushers and having a stretch adjacent the side lower guide elements.

5. The hardening apparatus defined in claim 1, further comprising means for vertically displacing and fixing the upper side guide elements relative to the lower side guide elements, whereby the vertical spacing between the side guide elements and the height of the side gaps can be varied.

6. The hardening apparatus defined in claim 1, further comprising respective side supports pivoted about at least one generally center longitudinal axis and having outer ends carrying the side guides; and means for pivoting and fixing the side supports and the side guides carried thereby and thereby setting the vertical positions of the side gaps relative to the center guide gap.

7. The hardening apparatus defined in claim 6 wherein the pivoting and fixing means includes a motor mounted stationarily adjacent the vessel.

8. The hardening apparatus defined in claim 6 wherein each of the supports is provided with transversely extending support elements along which the respective guide and pushers are transversely displaceable, whereby the horizontal position of the side guide gaps relative to the center guide gap can be varied.

9. The hardening apparatus defined in claim 1 wherein the lower guide elements have upstream and downstream ends extending longitudinally past the respective upper guide elements.

10. The hardening apparatus defined in claim 1 wherein the bending apparatus bends the blanks into an arcuate shape, the side gaps being generally level with each other and vertically offset from the center gap.

11. The hardening apparatus defined in claim 1 wherein the loading means includes a double fork engageable with the blanks to each side of the center guide.

* * * * *